US010745157B2

(12) United States Patent
Hendriks

(10) Patent No.: US 10,745,157 B2
(45) Date of Patent: Aug. 18, 2020

(54) APPARATUS FOR BANDING PRODUCTS

(71) Applicant: BANDALL PRODUCTIE B.V., Heemskerk (NL)

(72) Inventor: Henk Hendriks, Heemskerk (NL)

(73) Assignee: BANDALL PRODUCTIE B.V., Heemskerk (NL)

( * ) Notice: Subject to any disclaimer, the term of this patent is extended or adjusted under 35 U.S.C. 154(b) by 232 days.

(21) Appl. No.: 15/764,110

(22) PCT Filed: Oct. 7, 2016

(86) PCT No.: PCT/NL2016/050693

§ 371 (c)(1),
(2) Date: Mar. 28, 2018

(87) PCT Pub. No.: WO2017/061866

PCT Pub. Date: Apr. 13, 2017

(65) Prior Publication Data

US 2018/0282002 A1 Oct. 4, 2018

(30) Foreign Application Priority Data

Oct. 8, 2015 (NL) ..... 2015588

(51) Int. Cl.

| | |
|---|---|
| ***B65B 13/06*** | (2006.01) |
| ***B65B 13/18*** | (2006.01) |
| ***B65B 13/08*** | (2006.01) |

(52) U.S. Cl.

CPC ..... *B65B 13/08* (2013.01); *B65B 13/06* (2013.01); *B65B 13/184* (2013.01); *B65B 13/187* (2013.01)

(58) Field of Classification Search

CPC ..... B30B 13/184; B30B 13/187; B30B 13/06; B30B 13/08; B65B 13/184; B65B 13/187; B65B 13/06; B65B 13/08; B65B 13/22

(Continued)

(56) References Cited

U.S. PATENT DOCUMENTS 3,946,921 A * 3/1976 Noguchi ..... B65B 13/184 226/43

6,041,581 A 3/2000 Huber (Continued)

FOREIGN PATENT DOCUMENTS

DE 19853936 A1 9/1999
EP 0303129 A2 2/1989

(Continued)

OTHER PUBLICATIONS

PCT International Search Report and Written Opinion for PCT/NL2016/050693 dated Jan. 26, 2017.

*Primary Examiner* — Jimmy T Nguyen

(57) ABSTRACT

A device for banding products includes a supply mechanism for supplying band material from a supply roll at an unwinding speed, a strap chute for forming a loop in an end portion of the band material around a space for accommodating products at a banding speed, a cutter for cutting off the end portion and a sealer for closing the loop. A buffer mechanism is disposed between the supply mechanism and the strap chute, and includes at least a first and a second assembly of conveyors for conveying the band material from the supply mechanism to the strap chute at a conveying speed and a motor for driving the conveyors. The first and the second assembly of conveyors are driven independently of each other.

18 Claims, 4 Drawing Sheets

(58) Field of Classification Search
USPC ..... 100/26, 29, 33 R, 34
See application file for complete search history.

(56) References Cited

U.S. PATENT DOCUMENTS

| | | | | |
|---|---|---|---|---|
| 2004/0025718 | A1* | 2/2004 | Liu | B65B 13/184 100/4 |
| 2004/0060267 | A1* | 4/2004 | Shibazaki | B65B 13/184 53/589 |
| 2005/0044821 | A1* | 3/2005 | Schuttler | B65B 13/06 53/528 |
| 2006/0026932 | A1* | 2/2006 | Lai | B65B 13/184 53/589 |

FOREIGN PATENT DOCUMENTS

| | | | |
|---|---|---|---|
| EP | 0485097 | A1 | 5/1992 |
| EP | 1403184 | A1 | 3/2004 |
| EP | 2835315 | A1 | 2/2015 |
| WO | 2010012016 | A2 | 2/2010 |

* cited by examiner

APPARATUS FOR BANDING PRODUCTS

CROSS REFERENCE TO RELATED APPLICATIONS

This is a national stage application filed under 35 U.S.C. 371 of pending international application PCT/NL2016/0050693, filed Oct. 7, 2016, which claims priority to Netherlands national patent application NL2015588, filed Oct. 8, 2015 the entirety of which applications are incorporated by reference herein."

BACKGROUND

The present invention relates to a device for banding products, comprising a supply mechanism for supplying band material from a supply roll at an unwinding speed, wrapping means for forming a loop in an end portion of the band material around a space for accommodating products at a banding speed, means for cutting off the end portion and means for closing the loop. Such a device is also known by the name of banding machine.

Banding comprises arranging a wrapper, also called banderole, around one or more products. A banderole is provided for, inter alia, bundling several products, imparting rigidity to one or more products and/or displaying, as an information carrier, information regarding the product.

In existing banding machines, band material is usually supplied in relatively great lengths from a supply roll. Such a supply roll has a relatively large mass inertia. In the prior art, if band material is to be supplied discontinuously and at great speeds, band material is already unwound from the roll before there is a need for band material. In this way a buffer of band material is formed. Existing buffer devices comprise one or more fixedly disposed rotatable cams, over which the band material is passed, and one or more movable guide cams, wherein the movable cams are moved away from the fixed cams in such a manner that the length of the band material being carried over the cams is increased. A drawback of such buffer devices is that undesirable dynamic effects can occur in the case of high feed rates of the band material, as a result of which the band material is unevenly loaded. Because of this, the speeds at which band material can be supplied and retracted are limited, resulting in a limited banding capacity.

Alternative buffer devices make use of gas pressure for applying a force to a free portion of the band material, such that a loop of band material is formed as a buffer. The gas pressure can be quickly increased and decreased without any dynamic effects, so that the building up and reducing of a buffer of band material can take place without machine parts being moved. No mass movement is required, therefore, and thus the maximum load of band material will be manageable, and the speeds at which band material can be supplied and retracted will be significantly higher.

In spite of the increased banding capacity of banding machines with gas pressure buffer devices, even higher supply and retraction speeds are currently desired.

BRIEF SUMMARY

It is an object of the present invention to provide a banding machine with a significantly higher banding capacity.

In order to achieve that object, the invention provides a device of the kind described in the introduction, which is characterised by a buffer mechanism between the supply mechanism and the wrapping means, comprising at least a first and a second assembly of conveying means for conveying the band material from the supply mechanism to the wrapping means at a conveying speed and driving means for driving the conveying means, wherein the first and the second assembly of conveying means are driven independently of each other. Such a buffer mechanism consisting of two independently driven assemblies of conveying means on the one hand prevents the band material from being loaded unevenly during the building up and reducing of the buffer of band material and on the other hand ensures that the band material precisely guided upon being conveyed from the supply mechanism to the wrapping means. Preferably, the conveying speed of the first assembly of conveying means substantially corresponds to the unwinding speed, and the conveying speed of the second assembly of conveying means substantially corresponds to the banding speed. The guided transport makes it possible to further increase the banding acceleration and speed, resulting in a higher banding capacity. Depending on the band material to be used, or on the materials of a band material built up of several layers (also called laminate), banding speeds of up to 10 m/s with banding accelerations of up to 160 $m/s^2$ can be achieved with a flexible band material having a thickness of 20-50 μm. A typical band material is a laminated plastic film.

In a preferred embodiment of the device according to the invention, at least one assembly of conveying means is movable in two opposite conveying directions. A special advantage of this embodiment is that the band material is precisely guided both while band material is being supplied to the wrapping means and while band material is being retracted from the wrapping means. As a result, the correct direction of entry and exit of the band material into and from the wrapping means is maintained, which is a highly determining factor for the correct running true of the band material and thus for the level of the maximum conveying speed, is precisely maintained at all times.

In another preferred embodiment, each assembly of conveying means comprises pulleys and at least one conveyor belt to be passed thereover. A special advantage of a buffer mechanism consisting of such assemblies is that the diameters of the pulleys can be varied relative to each other, making it possible to realise various transmission ratios. It is noted that the term "conveyor belt" is understood to include, inter alia, a conveyor belt, a conveyor rope or an assembly thereof and the like.

In another preferred embodiment, a free loop of band material is formed in the buffer mechanism, one and the same contact side of the band material is in contact with the conveyor belt of the first assembly of conveying means and the conveyor belt of the second assembly of conveying means, and the conveyor belt of the first assembly of conveying means extends substantially parallel to the conveyor belt of the second assembly of conveying means. In this way the free loop is conveyed, wherein the legs of the free loop extend substantially parallel to each other during the building up and reducing of the buffer of band material, so that they are conveyed independently of each other with a substantially constant distance between them. Such a configuration optimises the guided movement of the buffer of band material and thus contributes toward increasing the banding capacity of banding machines.

In another preferred embodiment, at least part of the conveyor belt surface that faces away from the pulleys is rough. A rough surface increases the frictional resistance between the conveyor belt and the band material and thus prevents the conveyor belt and the band material from moving relative to each other, which is also referred to as slip. The magnitude of the frictional resistance determines the maximum acceleration with which the conveyor belt can be driven without any slip worth mentioning occurring. A high frictional resistance allows a high acceleration, which makes it possible to convey band material forward and backward at a high speed.

In another preferred embodiment, at least part of the outer surface of at least one pulley and/or the surface that faces the pulleys of the conveyor belt of at least one assembly of conveying means is rough. Such a rough surface increases the frictional resistance between the pulley and the conveyor belt and thus prevents the pulley and the conveyor belt from moving relative to each other. Analogous to the above-described effect of an increased frictional resistance between the conveyor belt and the band material, this allows a high acceleration, making it possible to convey band material forward and backward at a high speed.

In another preferred embodiment, the pulleys are externally toothed, and the conveyor belts comprise toothed (on one side) endless belts for engaging the pulleys. A special advantage of this aspect is that the acceleration to be imparted to the pulley can be transmitted to the conveyor belt over a large acceleration range substantially without slip.

According to another preferred embodiment, the conveyor belts are at least partially permeable to gas, and the device further comprises blowing and/or suction means for generating a difference in gas pressure between the side of the band material that faces the conveyor belt and the side thereof that faces away from the conveyor belt. A special advantage of the combination of conveyor belts that are at least in part permeable to gas and such means that generate a difference in gas pressure is that it connects the band material to the conveyor belts, which increases the precision with which the band material is guided during transport, resulting in an increased banding capacity.

According to another embodiment, the blowing and/or suction means generate a partial vacuum. A special advantage of this is that the environment of the buffer mechanism and the buffer mechanism itself is kept clean.

In another preferred embodiment, the device comprises an at least partially gas-permeable cover plate on at least one side, preferably on a side opposite the blowing and/or suction means. Such a cover plate is preferably configured so that the blowing and/or suction means realise substantially homogeneously distributed high and low pressure zones in the vicinity of the buffer mechanism. This makes it possible to apply the gas pressure difference between the side of the band material to be conveyed that faces the conveyor belt and the side thereof that faces away from the conveyor belt, such that the difference in gas pressure is substantially homogeneously distributed along the length of the band material and is furthermore sufficiently high for connecting the band material to the conveyor belts during the building up of the buffer and sufficiently low for disconnecting the band material during the reducing of the buffer, i.e. during the winding process.

In another preferred embodiment, at least one pulley of each assembly of conveying means is driven, the axes of rotation of the pulleys extend substantially parallel to each other and/or the circular centre planes of the pulleys lie substantially in one and the same flat plane. It is noted that if conveyor ropes are used, the orientation and the position of the pulleys are less important, since the conveyor ropes can have any orientation relative to each other for realising the desired gripping and guiding effect.

BRIEF DESCRIPTION OF THE DRAWINGS

The invention will now be explained in more detail with reference to figures illustrated in a drawing, in which.

DETAILED DESCRIPTION

Figure 1:
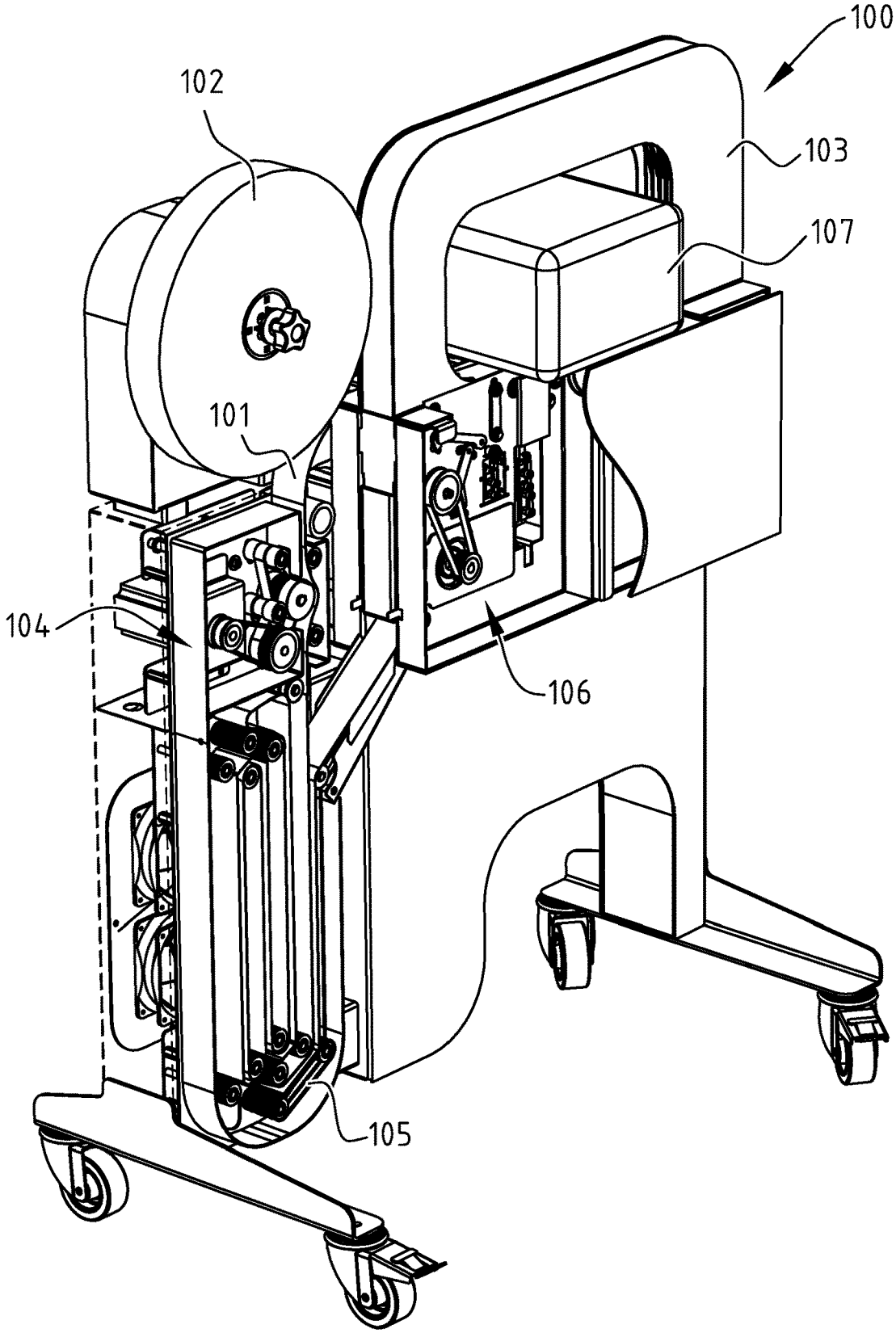
FIG. 1 is a perspective view of a banding machine according to a preferred embodiment of the invention.

FIG. 1 shows a perspective view of a banding machine 100. Such a banding machine carries band material 101 from a supply roll 102 through the machine to wrapping means 103. In its path to the wrapping means 103, the band material 101 is successively carried through a first supply mechanism 104, passed over a set of conveyor ropes 105 and carried to the wrapping means 103 via a second supply mechanism 106. The wrapping means 103 subsequently form a loop of band material 101 about a product 107 to be banded. Finally, the loop of band material 101 is closed under the product 107, for example using an adhesive bond, and the closed loop is cut loose from the upstream band material 101 by cutting means. It is noted that in the illustrated embodiment the second supply mechanism 106 is capable of conveying the band material 101 in two opposite directions, so that the band material 101 can be retracted for tightening the loop of band material 101 around the product 107 to be banded before closing of the loop takes place.

Figure 2:
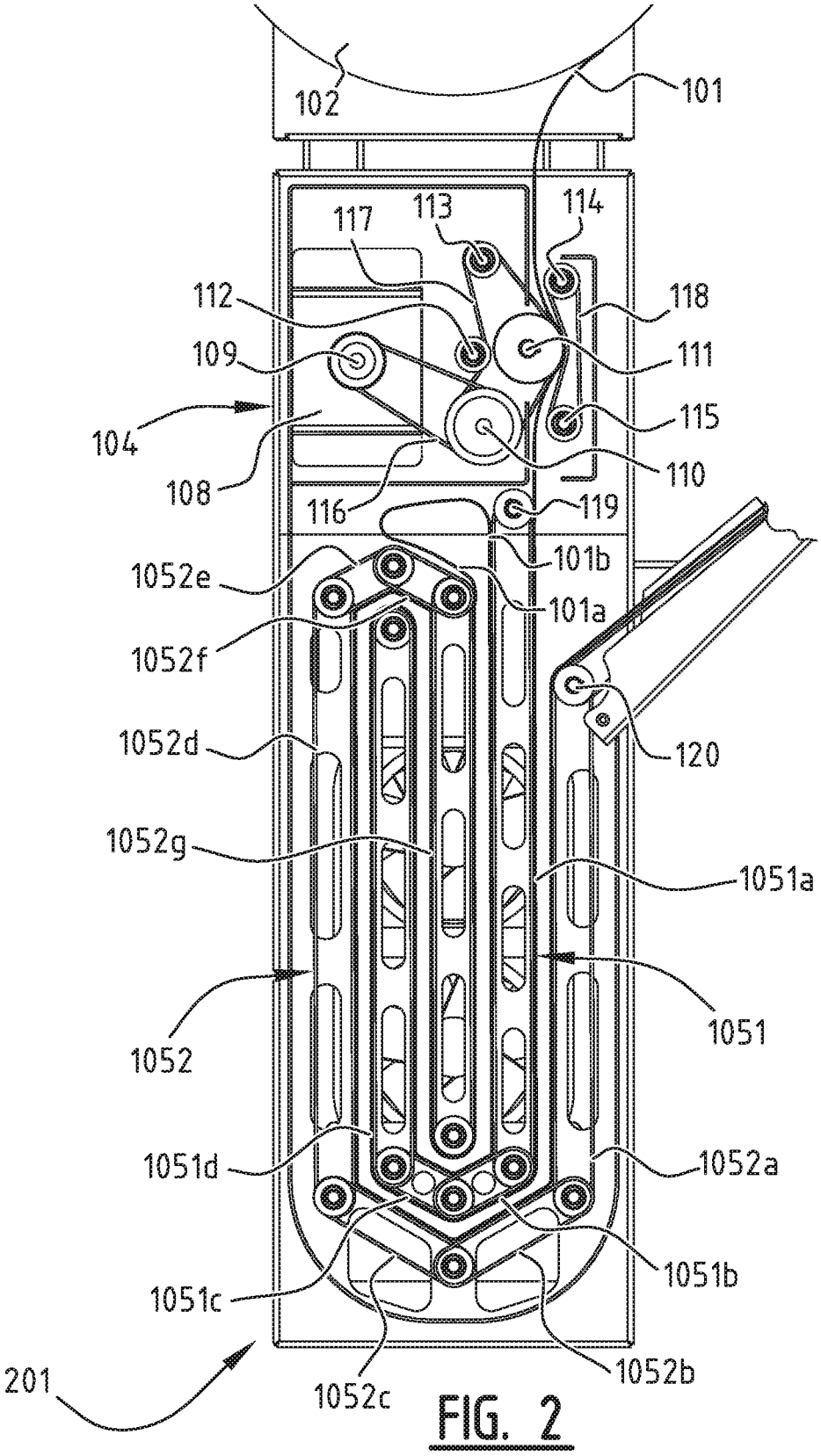
FIG. 2 is a cross-sectional view of a part of the banding machine of FIG. 1.

FIG. 2 shows a cross-sectional view of a part of the banding machine 100, in which the path of the band material 101 through the first supply mechanism 104 and over the set of conveyor ropes 105 toward the second supply mechanism 106 is shown. FIG. 2 further shows parts of the first supply mechanism 104, consisting of an electric motor 108, gears 109, 110 and 111, tension pulleys 112, 113, 114 and 115 and conveyor belts 116, 117 and 118. Finally, FIG. 2 shows that the set of conveyor ropes 105 consists of two main sets of conveyor ropes 1051 and 1052, which are each driven by separate electric motors via driven pulleys 119 and 120. The main set 1051 comprises 4 sets of conveyor ropes 1051*a*, 1051*b*, 1051*c* and 1051*d*. The main set 1052 in turn comprises 7 sets of conveyor ropes 1052*a*, 1052*b*, 1052*c*, 1052*d*, 1052*e*, 1052*f* and 1052*g*. In this way the two main sets 1051 and 1052 form a buffer mechanism 201, which conveys each of the legs 101*a* and 101*b* of a free loop of the band material 101 at an individual speed. As a result, the speed at which band material 101 is unwound from the supply roll 102 is unlinked from the speed at which band material 101 is arranged around a product 107 by the wrapping means 103. At the same time, the conveyor ropes 1052 of the second set are movable in two opposite directions, so that the band material 101 can be retracted in cooperation with the second supply mechanism 106 for being stretched around the product 107. The cooperation between the parts of the buffer mechanism 201 will be explained in more detail with reference to FIG. 3.

Figure 3:
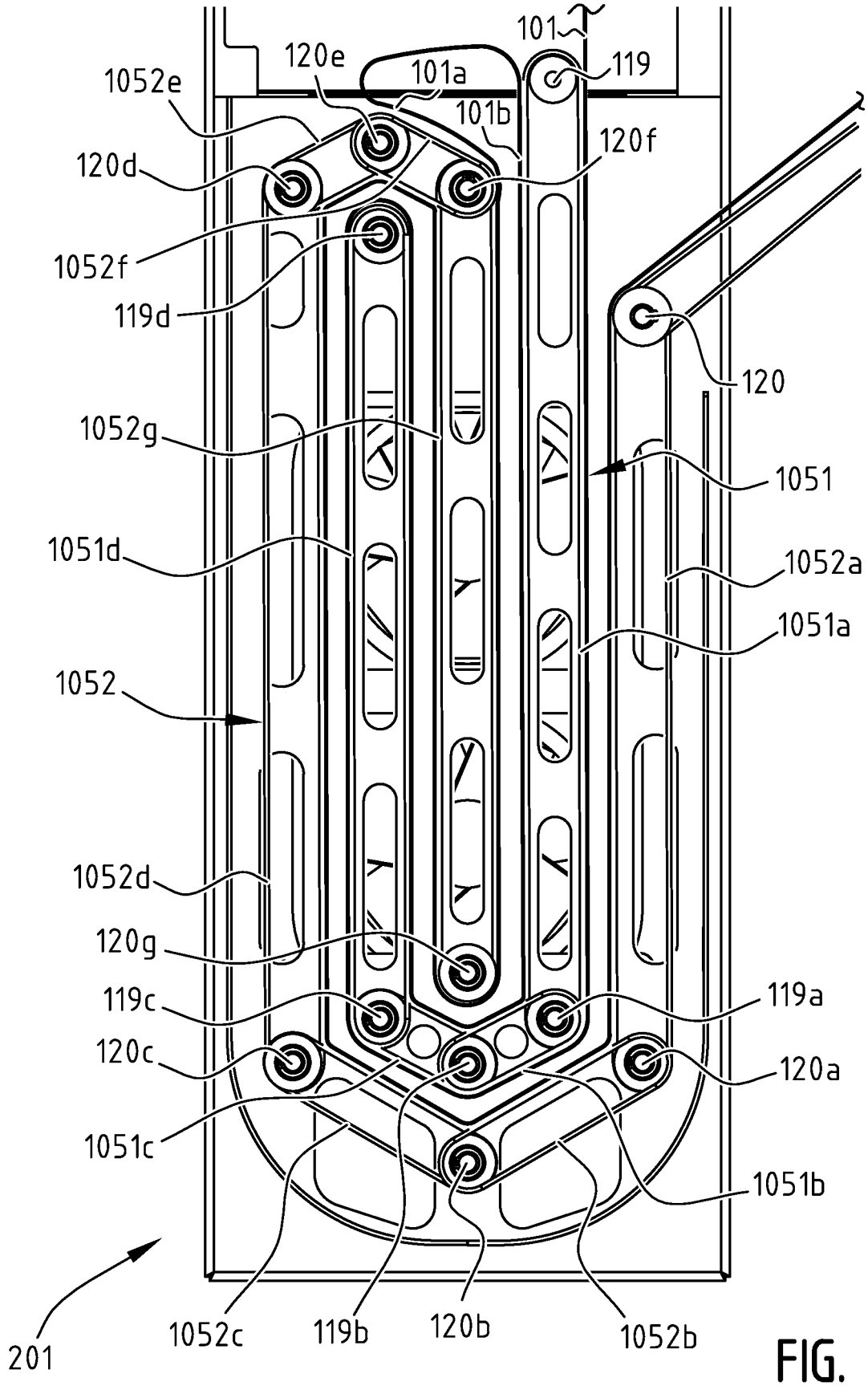
FIG. 3 is a cross-sectional view of the buffer mechanism in the banding machine of FIG. 1.

FIG. 3 shows a cross-sectional view of the buffer mechanism 201. The buffer mechanism 201 consists of two pulleys 119 and 120 driven by separate electric motors (not shown), which pulleys are capable of rotating the pulleys 119*a*, 119*b*, 119*c*, 119*d* and the pulleys 120*a*, 120*b*, 120*c*, 120*d*, 120*e*, 120*f*, 120*g* via sets of conveyor ropes 1051*a-d* and 1052*a-g*, respectively. The main set of conveyor ropes 1051 is thus driven separately from the set of conveyor ropes 1052. By causing the driven pulley 119 to rotate clockwise, a buffer of band material 101 from the supply roll 102, shown as a free loop of band material with legs 101*a* and 101*b* in FIG. 3, can be built up by the buffer mechanism 201. By causing the driven pulley 120 to rotate clockwise, the buffer of band material 101, shown as a free loop of band material with legs 101*a* and 101*b* in FIG. 3, can be reduced by a buffer mechanism 201. The unwinding of the band material 101 from the supply roll 102 is thus unlinked from the wrapping of the band material 101 around the product 107. Because the two sets of conveyor ropes 1051 and 1052 are driven separately from each other, the speed at which band material is unwound from the supply roll 102 is unlinked from the speed at which band material 101 is arranged around a product 107 by the wrapping means 103. Uneven loading of the band material during the wrapping process can therefore be prevented and the banding speed can be increased, resulting in a higher banding capacity. Finally it should be noted that the driven pulley 120 is driven by an electric motor which also drives the second supply mechanism 6. The second main set of conveyor ropes 1052 is therefore movable in two opposite directions, so that the band material 101 can be retracted in cooperation with the second supply mechanism 106 for being stretched around the product 107.

Figure 4:
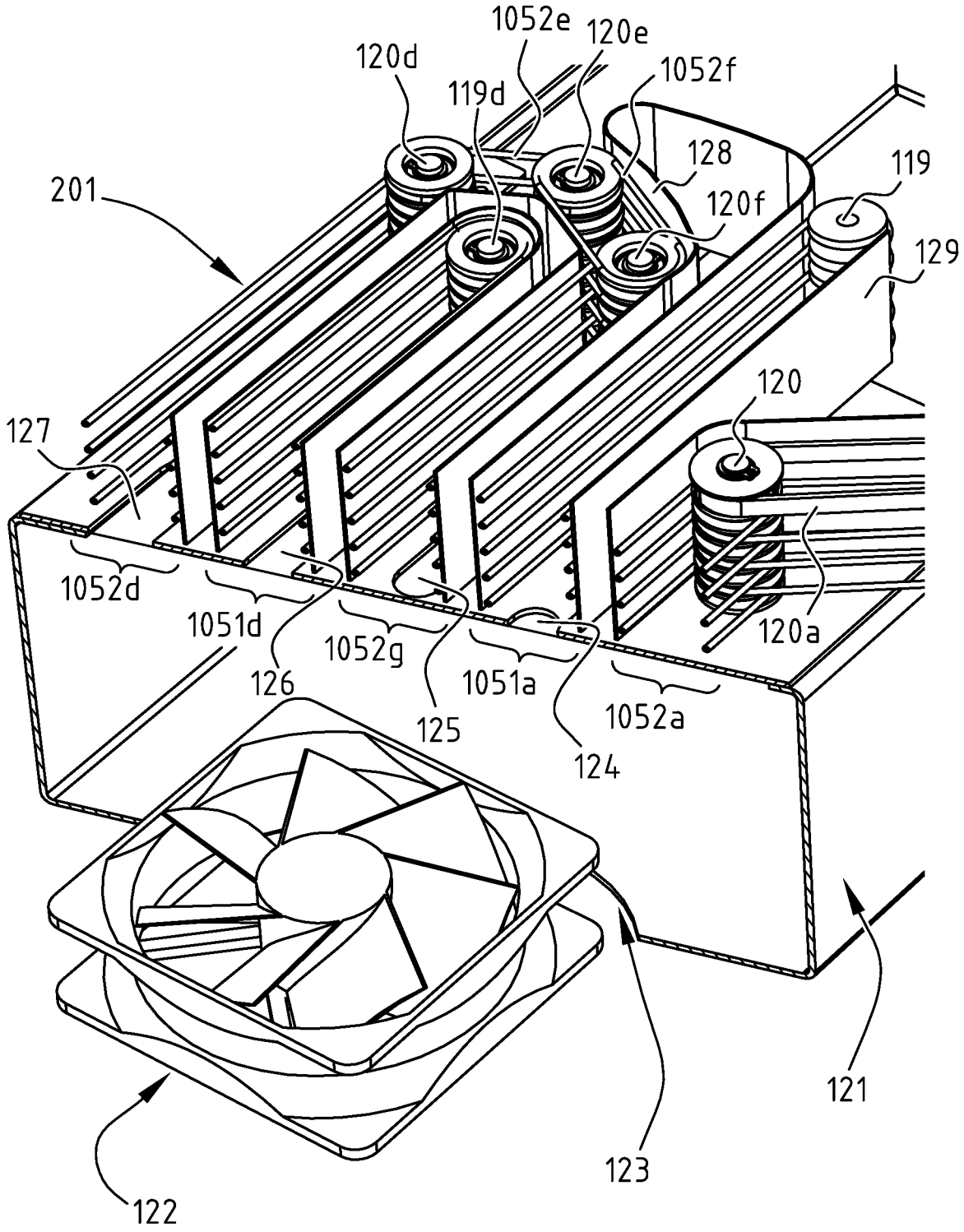
FIG. 4 is a perspective, cross-sectional view of the buffer mechanism in the banding machine of FIG. 1.

FIG. 4 shows a perspective cross-sectional view of the buffer mechanism. The figure shows driven pulleys 119 and 120 and a toothed belt 120*a*, which connects the pulley 120 to an electric motor (not shown) of the second supply mechanism 106. FIG. 4 also shows pulleys 119*d* and 120*d*, 120*e* and 120*f* and cross-sectional views of the sets of conveyor ropes 1051*a*, 1051*d*, 1052*a*, 1052*e*, 1052*f* and 1052*g*, consisting of 4 or 5 substantially parallel conveyor ropes which are each passed over two pulleys. In the illustrated embodiment, the pulleys are provided on the outer side of the walls of a housing 121. In the illustrated embodiment, the space between the individual conveyor ropes of each set allows air or another gas to flow between the conveyor ropes. In combination with blowing and/or suction means 122 and holes 123, 124, 125, 126 and 127 in the side walls of the housing 121, which allow air to pass therethrough, a difference in air pressure can be generated between the side 128 of the band material 101 that faces the conveyor ropes and the side 129 thereof that faces away from the conveyor ropes. As a result, the band material 101 is connected to sets of conveyor ropes, which increases the precision of guiding during transport, resulting in an increased banding capacity.

The device may also comprise an at least partially air-permeable cover plate (not shown) on at least one side, preferably on a side opposite the blowing and/or suction means. Such a cover plate will in that case preferably be configured so that the blowing and/or suction means realise substantially homogeneously distributed high and low pressure zones in the vicinity of the buffer mechanism. This makes it possible to realise the difference in air pressure between the two sides of the band material to be conveyed such that the difference in air pressure will be distributed substantially homogeneously along the length of the band material and that said difference in air pressure will be sufficiently high for connecting the band material to the conveyor belts during the building up of a buffer and sufficiently low for disconnecting the band material during the reducing of the buffer, i.e. during the wrapping process.

The invention is not limited to the embodiment shown herein, but it also extends to other preferred variants that fall within the scope of the appended claims.

The invention claimed is:

1. A device for banding products, comprising:

a supply mechanism for supplying band material from a supply roll at an unwinding speed, wrapping means for forming a loop in an end portion of the band material around a space for accommodating products at a banding speed, a cutter for cutting off the end portion and a sealer for closing the loop, and a buffer mechanism for forming a buffer of the band material, the buffer mechanism is positioned between the supply mechanism and the wrapping means, comprising at least a first assembly of conveying means and a second assembly of conveying means for conveying the band material from the supply mechanism to the wrapping means at a conveying speed and driving means for driving the conveying means, wherein the first assembly of conveying means and the second assembly of conveying means are driven independently of each other; and wherein each of said first assembly of conveying means and said second assembly of conveying means comprises pulleys and at least one conveyor belt to be passed thereover.

2. The device according to claim 1, wherein the conveying speed of the first assembly of conveying means corresponds to the unwinding speed, and wherein the conveying speed of the second assembly of conveying means corresponds to the banding speed.

3. The device according to claim 1, wherein at least one assembly of conveying means is movable in two opposite conveying directions.

4. The device according to claim 1, wherein a free loop of band material is formed in the buffer mechanism, and wherein a same contact side of the band material is in contact with the conveyor belt of the first assembly of conveying means and the conveyor belt of the second assembly of conveying means.

5. The device according to claim 1, wherein the conveyor belt of the first assembly of conveying means extends parallel to the conveyor belt of the second assembly of conveying means.

6. The device according to claim 1, wherein at least part of a surface of the conveyor belt that faces away from the pulleys is rough.

7. The device according to claim 1, wherein at least part of an outer surface of at least one pulley of at least one assembly of conveying means is rough; and wherein at least part of a surface that faces the pulleys, of the conveyor belt of said at least one assembly of conveying means, is rough.

8. The device according to claim 1, wherein the pulleys are externally toothed, and wherein the conveyor belts comprise toothed endless belts for engaging the pulleys.

9. The device according to claim 1, wherein the conveyor belts are at least partially permeable to gas, and wherein the device further comprises a fan for generating a difference in gas pressure between a side of the band material that faces the conveyor belt and a side thereof that faces away from the conveyor belt.

10. The device according to claim 9, wherein the fan is configured to generate a partial vacuum in use.

11. The device according to claim 9, wherein the device comprises an at least partially gas-permeable cover plate on at least one side of the fan.

12. The device according to claim 11, wherein the cover plate is configured so that the fan realises high and low pressure zones in a vicinity of the buffer mechanism, such that a gas pressure difference is homogeneously distributed along a length of the band material connects the band material to the conveyor belts during a building up of a buffer of said band material and disconnects the band material from the conveyor belts during a reducing of the buffer of said band material.

13. The device according to claim 1, wherein at least one pulley of each said assembly of conveying means is driven.

14. The device according to claim 1, wherein axes of rotation of said pulleys extend parallel to each other.

15. The device according to claim 1, wherein circular centre planes of said pulleys lie in a same flat plane.

16. The device according to claim 1, wherein at least part of an outer surface of at least one pulley of at least one assembly of conveying means is rough; or wherein at least part of a surface that faces the pulley, of the conveyor belt of said at least one assembly of conveying means, is rough.

17. The device according to claim 8, wherein the toothed endless belts are toothed on one side.

18. The device according to claim 11, wherein the at least partially gas-permeable cover plate is disposed on a side of the fan that is opposite the fan.

* * * * *